164-463 SR
6/30/87 OR 4,676,298

United States Patent [19]
Liebermann

[11] Patent Number: 4,676,298
[45] **Date of Patent: * Jun. 30, 1987**

[54] CASTING IN A LOW DENSITY ATMOSPHERE

[75] Inventor: Howard H. Liebermann, Succasunna, N.J.

[73] Assignee: Allied Corporation, Morris Township, Morris County, N.J.

[ * ] Notice: The portion of the term of this patent subsequent to May 12, 2004 has been disclaimed.

[21] Appl. No.: 781,207

[22] Filed: Sep. 30, 1985

Related U.S. Application Data

[63] Continuation of Ser. No. 483,475, Apr. 11, 1983, abandoned.

[51] Int. Cl.[4] ..... B22D 11/06
[52] U.S. Cl. ..... 164/463; 164/423
[58] Field of Search ..... 164/463, 423, 427, 429, 164/479, 415, 475, 473

[56] References Cited

U.S. PATENT DOCUMENTS

| | | | |
|---|---|---|---|
| 3,861,450 | 1/1975 | Mobley et al. | 164/479 X |
| 3,862,658 | 1/1975 | Bedell | 164/423 X |
| 4,282,921 | 8/1981 | Liebermann | 164/463 |
| 4,301,855 | 11/1981 | Suzuki et al. | 164/254 |

*Primary Examiner*—Kuang Y. Lin
*Attorney, Agent, or Firm*—Ernest D. Buff; Gerhard H. Fuchs

[57] ABSTRACT

An apparatus and method for casting metal strip include a moving chill body that has a quench surface. A nozzle mechanism deposits a stream of molten metal on a quenching region of the quench surface to form the strip. The nozzle mechanism has an exit portion with a nozzle orifice. A depletion mechanism supplies a low density atmosphere to a depletion region located adjacent to and upstream of the quenching region. The quench surface is heated to a temperature that substantially prevents precipitation of condensed or solidified constituents from the low density atmosphere onto the depletion region.

17 Claims, 6 Drawing Figures

CASTING IN A LOW DENSITY ATMOSPHERE

This application is a continuation of application Ser. No. 483,475 filed Apr. 11, 1983, now abandoned.

BACKGROUND OF THE INVENTION

1. Field of the Invention

The invention relates to the casting of metal strip directly from a melt, and more particularly to the rapid solidification of metal directly from a melt to form substantially continuous metal strip.

2. Description of the Prior Art

U.S. Pat. No. 4,142,571 issued to M. Narasimhan discloses a conventional apparatus and method for rapidly quenching a stream of molten metal to form continuous metal strip. The metal can be cast in an inert atmosphere or a partial vacuum. U.S. Pat. Nos. 3,862,658 issued to J. Bedell and 4,202,404 issued to C. Carlson disclose flexible belts employed to prolong contact of cast metal filament with a quench surface.

The casting of very smooth strip has been difficult with conventional devices because gas pockets entrapped between the quench surface and the molten metal during quenching form gas pocket defects. These defects, along with other factors, cause considerable roughness on the quench surface side as well as the opposite, free surface side of the cast strip. In some cases, the surface defects actually extend through the strip, forming perforations therein.

U.S. Pat. No. 4,154,283 issued to R. Ray et al. discloses that vacuum casting of metal strip reduces the formation of gas pocket defects. The vacuum casting system taught by Ray et al. requires specialized chambers and pumps to produce a low pressure casting atmosphere. In addition, auxiliary means are required to continuously transport the cast strip out of the vacuum chamber. Further, in such a vacuum casting system, the strip tends to weld excessively to the quench surface instead of breaking away as typically happens when casting in an ambient atmosphere.

U.S. Pat. No. 4,301,855 issued to H. Suzuki et al. discloses an apparatus for casting metal ribbon wherein the molten metal is poured from a heated nozzle onto the outer peripheral surface of a rotary roll. A cover encloses the roll surface upstream of the nozzle to provide a chamber, the atmosphere of which is evacuated by a vacuum pump. A heater in the cover heats the roll surface upstream from the nozzle to remove dew droplets and gases from the roll surface. The vacuum chamber lowers the density of the moving gas layer next to the casting roll surface, thereby increasing formation of air pocket depressions in the cast ribbon. The heater helps drive off moisture and adhered gases from the roll surface to further decrease formation of air pocket depressions.

The apparatus disclosed by Suzuki et al. does not pour metal onto the casting surface until that surface has exited the vacuum chamber. By this procedure, complications involved in removing a rapidly advancing ribbon from the vacuum chamber are avoided. The ribbon is actually cast in the open atmosphere, offsetting any potential improvement in ribbon quality.

U.S. Pat. No. 3,861,450 to Mobley, et al. discloses a method and apparatus for making metal filament. A disk-like, heat-extracting member rotates to dip an edge surface thereof into a molten pool, and a non-oxidizing gas is introduced at a critical process region where the moving surface enters the melt. This non-oxidizing gas can be a reducing gas, the combustion of which in the atmosphere yields reducing or non-oxidizing combustion products at the critical process region. In a particular embodiment, a cover composed of carbon or graphite encloses a portion of the disk and reacts with the oxygen adjacent the cover to produce non-oxidizing carbon monoxide and carbon dioxide gases which can then surround the disk portion and the entry region of the melt.

The introduction of non-oxidizing gas, as taught by Mobley, et al., disrupts and replaces an adherent layer of oxidizing gas with the non-oxidizing gas. The controlled introduction of non-oxidizing gas also provides a barrier to prevent particulate solid materials on the melt surface from collecting at the critical process region where the rotating disk would drag the impurities into the melt to the point of initial filament solidification. Finally, the exclusion of oxidizing gas and floating contaminants from the critical region increases the stability of the filament release point from the rotating disk by decreasing the adhesion therebetween and promoting spontaneous release.

Mobley, et al., however, address only the problem of oxidation at the disk surface and in the melt. The flowing stream of non-oxidizing gas taught by Mobley, et al. is still drawn into the molten pool by the viscous drag of the rotating wheel and can separate the melt from the disk edge to momentarily disturb filament formation. The particular advantage provided by Mobley, et al. is that the non-oxidizing gas decreases the oxidation at the actual point of filament formation within the melt pool. Thus, Mobley, et al. fail to minimize the entrainment of gas that could separate and insulate the disk surface from the melt.

U.S. Pat. Nos. 4,282,921 and 4,262,734 issued to H. Liebermann disclose an apparatus and method in which coaxial gas jets are employed to reduce edge defects in rapidly quenched amorphous strips. U.S. Pat. Nos. 4,177,856 and 4,144,926 issued to H. Liebermann disclose a method and apparatus in which a Reynolds number parameter is controlled to reduce edge defects in rapidly quenched amorphous strip. Gas densities and thus Reynolds numbers, are regulated by the use of vacuum and by employing lower molecular weight gases.

Conventional methods, however, have been unable to adequately reduce surface defects in cast metal strip caused by the entrapment of gas pockets. Vacuum casting procedures have afforded some success, but when using vacuum casting, excessive welding of the cast strip to the quench surface and the difficultly of removing the cast strip from the vacuum chamber have resulted in lower yields and increased production costs. As a result, conventional methods have been unable to provide a commercially acceptable process that efficiently produces smooth strip with consistent quality and uniform cross-section.

SUMMARY OF THE INVENTION

The invention provides an apparatus and method for efficiently casting smooth metal strip and substantially preventing the formation of gas pocket defects therein. The apparatus of the invention includes a moving chill body having a quench surface, and includes a nozzle means for depositing a stream of molten metal on a quenching region of the quench surface to form the strip. The nozzle means has a exit portion with a nozzle orifice. A depletion means supplies a low density atmosphere at a depletion region located adjacent to and upstream of the quenching region. A control means substantially prevents precipitation of condensed or solidified constituents from the low density atmosphere onto the depletion region.

In accordance with the invention there is also provided a method for casting continous metal strip. A chill body having a quench surface is moved at a selected speed, and a stream of molten metal is deposited on a quenching region of the quench surface to form the strip. A low density atmosphere is supplied to a depletion region located adjacent to and upstream of said quenching region. The quench surface is heated to a temperature that substantially prevents precipitation of condensed or solidified constituents from the atmosphere onto the depletion region.

The invention further provides a metal strip having a thickness of less than about 15 micrometers in the ascast state.

The method and apparatus of the invention advantageously minimize the formation and entrapment of gas pockets against the quenched surface during the casting of the strip. As a result, the invention avoids the needs for complex vacuum casting apparatus and can be practiced in an ambient atmosphere. The heating of the quench surface surprisingly provides better and more uniform cooling and quenching of the molten metal. The low-density atmosphere and heated quench surface reduce the formation of gas pockets operating to decrease contact between the molten metal and the quench surface. The more uniform quenching, in turn, provides improved physical properties in the cast strip. In particular, the reduction of surface defects on the quenched surface side of the strip increases the packing factor of the material and reduces localized stress concentrations that can cause premature fatigue failure. The smoothness of the free surface side of the cast strip (i.e. the side not in contact with the quench surface of the chill body) is also improved by the method and apparatus of the invention. This increased smoothness further increases the packing factor of the material. In production of amorphous metal strip, the more uniform quenching afforded by the heated quench surface and low density atmosphere provide a more consistent and uniform formation of the amorphous state. In manufacture of the strip composed of magnetic material, the number and size of strip surface discontinuities is reduced, improving the magnetic properties of the strip.

Surface defects due to entrapped gas pockets are reduced, and there is much less chance for a gas pocket to perforate the strip. Suprisingly, very thin strips (less than about 15 micrometers in thickness) have been produced. These very thin strips are highly desirable in various applications. For example, in magnetic devices, such as inductors, reactors and high frequency electromagnetic devices, thin magnetic material substantially reduces power losses therein. In brazing, the use of thinner brazing foils substantially improves the strength of the brazed joints.

Morever, the reduction of entrapped gas pockets markedly increases the heat conductive contact between the molten metal and the quench surface. Thicker strips of rapidly solidified metal can be produced. Such thicker strip is desireable because it can be more easily substituted for materials conventionally used in existing commercial applications. These thick strip components can, suprisingly, be provided by rapid solidification in a single quenching step in much less time with decreased cost.

Thus, the present invention effectively minimizes gas pocket defects on the strip surface which contacts the quench surface, and produces strip having a smooth surface finish and uniform physical properties. Complex equipment and procedures associated with vacuum casting are eliminated. The invention efficiently casts ultra thin as well as extra thick metal strip directly from the melt at lower cost and with higher yield. Such ultra thin and extra thick strips are especially suited for use in such applications as magnetic devices, and can be substituted for conventional materials with greater effectiveness and economy.

BRIEF DESCRIPTION OF THE DRAWINGS

The invention will be more fully understood and further advantages will become apparent when reference is made to the following detailed description of the preferred embodiment of the invention and the accompanying drawings in which.

DESCRIPTION OF PREFERRED EMBODIMENTS

For the purposes of the present invention and as used in the specification and claims, a strip is a slender body the transverse dimensions of which are much smaller than its length. Thus, a strip includes wire, ribbon, sheet and the like of regular or irregular cross-section.

The invention is suitable for casting metal strip composed of crystalline or amorphous metal and is particularly suited for producing metal strip which is rapidly solidified and quenched at a rate of at least about $10^{4}$° C./sec from a melt of molten metal. Such rapidly solidified strip has improved physical properties, such as improved tensile strength, ductility and magnetic properties.

Figure 1:
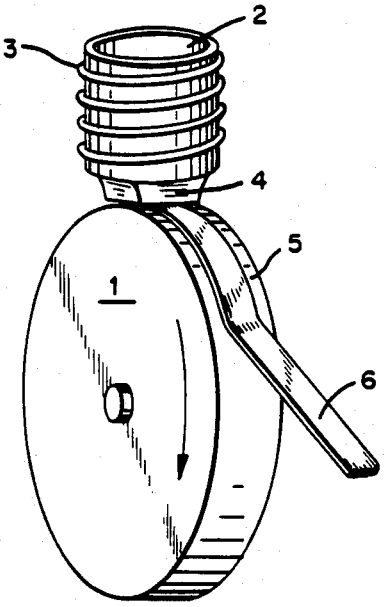
PRIOR ART FIG. 1
FIG. 1 shows a representative prior art apparatus for rapidly casting metal strip.

FIG. 1 shows a representative prior art device for rapidly casting continuous metal strip. Molten metal alloy contained in crucible 2 is heated by a heating element 3. Pressurization of the crucible with an inert gas forces a molten stream through a nozzle 4 at the base of the crucible and deposits the molten metal onto a moving chill body, such as rotatable casting wheel 1. Solidified moving strip 6, after its break-away point from the quench wheel is then routed onto a suitable winding means.

Quench surface 5 (substrate) is preferably a material having high thermal conductivity. Suitable materials include carbon steel, stainless steel and copper based alloys such as beryllium copper. To achieve the quench rates of at least about $10^{4}$° C. per second, wheel 1 is internally cooled and rotated to provide a quench surface that advances at a speed ranging from about 100–4000 meters per minute. Preferably, the quench surface speed ranges from about 200–3000 meters per minute. Typically, the thickness of the cast strip ranges from 25–100 microns (micrometers).

Figure 2:
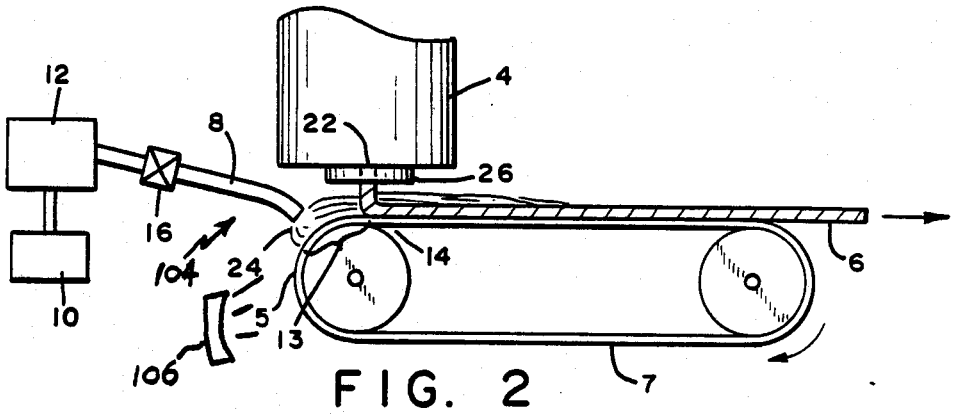
FIG. 2 shows a schematic representation of a embodiment of the invention which employs an endless casting belt.
Figure 3:
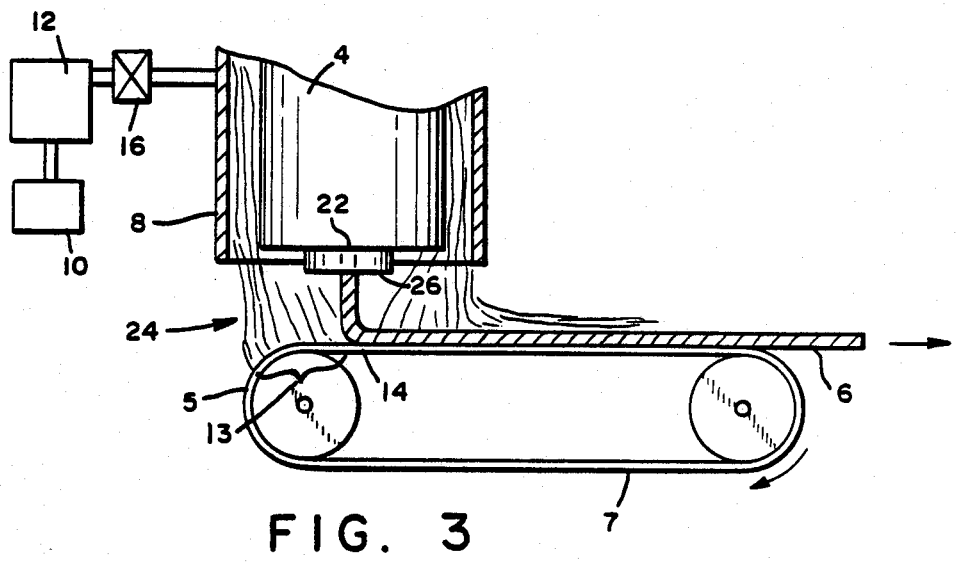
FIG. 3 shows an embodiment of the invention which employs a gas delivery means located coaxial with a casting nozzle.

FIG. 2 shows a representative apparatus of the invention. A moving chill body, such as endless casting belt 7, has a chilled casting quench surface 5. Nozzle means, such as nozzle 4, deposits a stream of molten metal onto a quenching surface 14 of quench surface 5 to form strip 6. Nozzle 4 has an orifice 22 located at exit portion 26. A depletion means is comprised of gas nozzle delivery means 8, heater means 10, and gas supply 12. The depletion means supplies a gas 24 from gas supply 12 to produce a low density atmosphere and directs the gas with gas nozzle 8 to a depletion region 13 located adjacent to and upstream of quenching region 14. Nozzle 8 is suitably located to direct gas 24 at and around the depletion region 13 so that the gas 24 substantially floods the depletion region 13, providing a low density atmosphere therewithin. A control means 104 comprised of an infrared heater 106, laser or the like disposed proximate the quench surface 5, heats the quench surface 5 to a temperature that substantially prevents precipitation of condensed or solidified constituents from the atmosphere onto the depletion region 13. Valve 16 regulates the volume and velocity through nozzle 8. As shown in FIG. 2, gas nozzle 8 is located upstream of quenching region 14 and is directed along the direction of movement of the quench surface. Optionally, gas nozzle 8 can be located coaxial with casting nozzle 4 as representatively shown in FIG. 3.

The term low density atmosphere, as used in the specification and claims hereof, means an atmosphere having a gas density less than 1 gram per liter and preferably, having a gas density of of less than about 0.5 grams per liter.

To obtain the desired low-density atmosphere, gas 24 is heated to at least about 800K, and more preferably, is heated to at least about 1300K. In general, hotter gases are preferred because they will have lower densities and will better minimize the formation and entrapment of gas pockets between quench surface 5 and the deposited molten metal.

Entrapped gas pockets are undesirable because they produce ribbon surface defects that degrade the surface smoothness. In extreme cases, the gas pockets will cause perforations through strip 6. A very smooth surface finish is particularly important when winding magnetic metal strip to form magnetic cores because surface defects reduce the packing factor of the material. The packing factor is the volume fraction of the actual magnetic material in the wound core (the volume of magnetic material divided by the total core volume) and is often expressed in percent. A smooth surface without defects is also important in optimizing the magnetic properties of strip 6 and in minimizing localized stress concentrations that would otherwise reduce the mechanical strength of the strip.

Gas pockets also insulate the deposit molten metal from quench surface 5 and reduce the quench rate in localized areas. The resultant, non-uniform quenching produces non-uniform physical properties in strip 6, such as non-uniform strength, ductility and magnetic properties.

For example, when casting amorphous metal strip, gas pockets can allow undesired crystallization in localized portions of the strip. The gas pockets and the local crystallizations produce discontinuities which inhibit movement of magnetic domain walls, thereby degrading the magnetic properties of the material.

Thus, by reducing the entrapment of gas pockets, the invention produces high quality metal strip with improved surface finish and improved physical properties. For example, metal strip has been produced with packing factors of at least about 80%, and up to about 95%.

Figure 6:
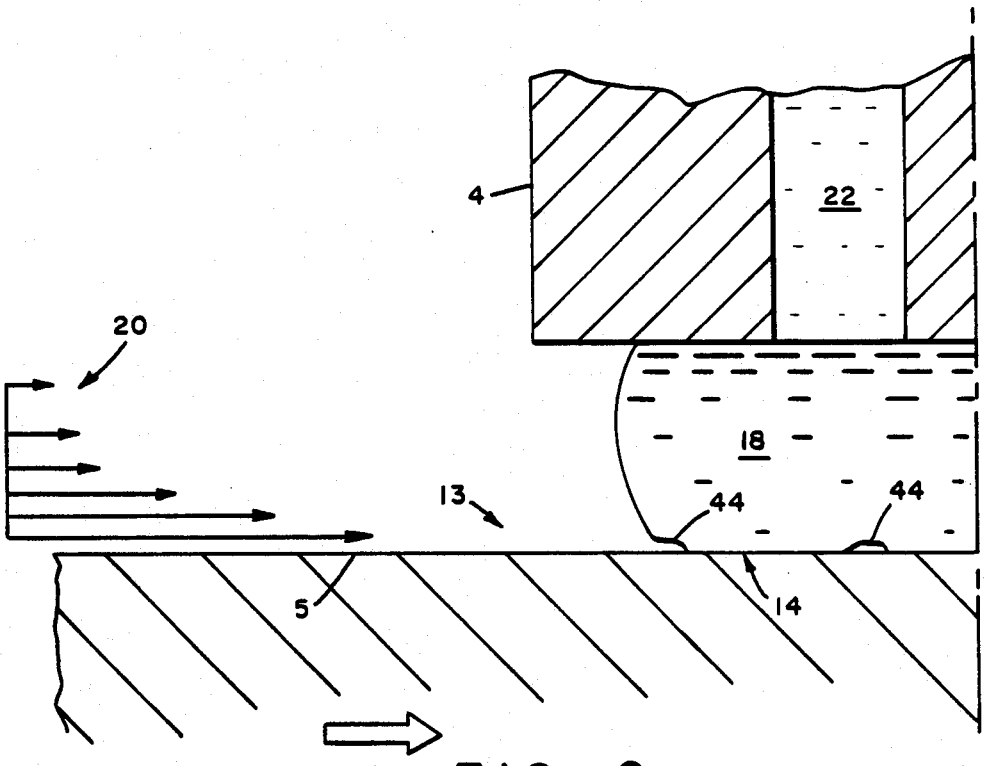
FIG. 6 shows a gas velocity profile at the quench surface portion on which molten metal is deposited.

The mechanism by which gas pockets are reduced can be more readily explained with reference to FIG. 6. The gas boundary layer velocity profile near quench surface 5 and upstream of melt puddle 18 is shown schematically at 20. The maximum gas boundary layer velocity occurs immediately adjacent to quench surface 5 (substrate) and is equal to the velocity of the moving quench surface. Thus, moving quench surface 5 ordinarily draws cool air from the ambient atmosphere into upstream region 13 and into quenching region 14, the region of the quench surface upon which molten metal is deposited. Because of the drafting of relatively cool air into the quenching region, the presence of the hot casting nozzle and the molten metal do not sufficiently heat the local atmosphere to significantly reduce the density thereof.

Melt puddle 18 wets the substrate surface to an extent determined by various factors including the metal alloy composition, the substrate composition, and the presence of surface films. The pressure exerted by the gas boundary layer at the melt-substrate interface, however, acts to locally separate the melt from the substrate and form entrained gas pockets which will appear as "lift-off" areas 44 on the ribbon underside. The stagnation pressure of the gas boundary layer (pressure if the layer hit a rigid wall) is given by the formula $P_s=\frac{1}{2}\rho v^2$ where: $\rho$=gas density, v=substrate velocity. Therefore, the reduction of gas boundary layer density or substrate velocity are important in the reduction of the size and the number of gas pockets entrained under the molten metal puddle. example, removal of the gas boundary layer by casting in vacuum can totally eliminate the lift-off areas in the strip underside. Alternatively, a low density gas in the boundary layer could be employed. The selection of a low molecular weight gas (such as helium) is one way to reduce boundary layer gas density. However, the variety of low molecular weight gases which can be used in this fashion is quite limited. A preferred manner in which to reduce the boundary layer gas density is to use a heated gas; the density of the gas will diminish as the inverse of the absolute temperature. By directing the hot gas at the upstream side of the melt puddle 18, the size and the number of entrained gas pockets under the melt puddle can be substantially reduced.

It is important, however, to regulate pertinent factors, such as the composition of the low-density atmosphere, and the temperature of quench surface 5, to substantially prevent the formation of any solid or liquid matter which could precipitate onto depletion region 13. Such precipitate, if entrained between the melt puddle and quench surface, could produce surface defects and degrade the strip quality.

Surprisingly, the heating of the quench surface does not degrade the quenching of the molten metal. To the contrary, the heating of the quench substrate and the low density atmosphere actually improve the uniformity of the quench rate by minimizing the presence of insulating, entrapped gas pockets, and thereby improve the quality of the cast strip.

Preferably, gas 24 is a reducing gas; i.e. it is capable of causing a chemical reduction-type reaction. Accordingly, the gas itself is capable of undergoing chemical oxidation, preferably by combining with oxygen. Suitable reducing gases include carbon monoxide and gas mixtures thereof.

The presence of a reducing atmosphere at quench surface 5 has distinct advantages. In particular, a reducing atmosphere minimizes the oxidation of strip 6. In addition, the reducing atmosphere starves quench surface 5 of oxygen and minimizes the oxidation thereof. The reduced oxidation improves the wettability of the quench surface and allows molten metal to be more uniformly deposited on quench surface 5. In the case of a copper base materials in quench surface 5, the reduced oxidation renders the quench surface much more resistant to thermally induced fatigue crack nucleation and growth The reducing atmosphere also depletes oxygen from the region of nozzle 4 thereby reducing the clogging of nozzle orifice 22, particularly clogging due to oxide particulates. Optionally, additional gas nozzle 32 may be employed to provide additional reducing gas atmospheres downstream of nozzle 4 along selected portions of strip 6, as representatively shown in FIG. 4.

Figure 4:
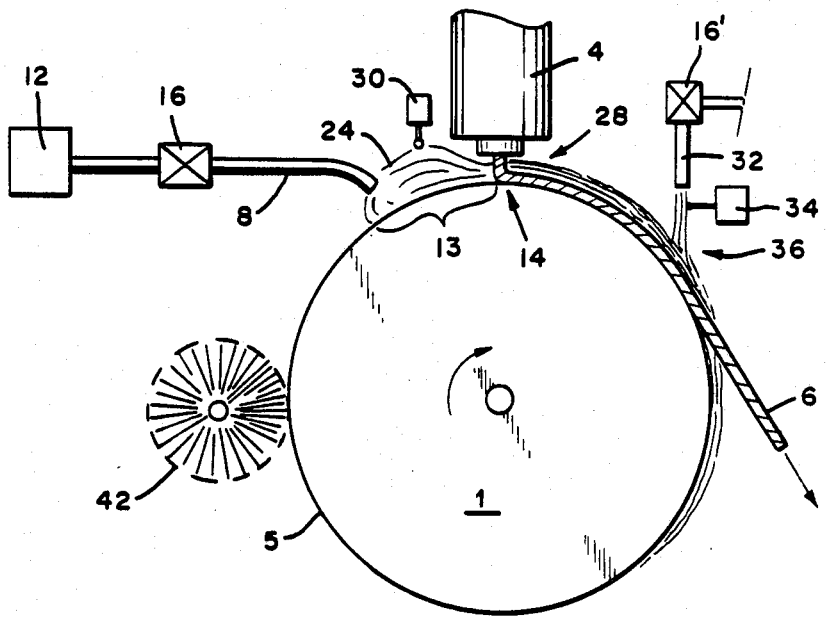
FIG. 4 shows an embodiment of the invention which employs a rotatable casting wheel.

FIG. 4 shows an embodiment of the invention wherein the reducing gas is capable of being ignited and burned to form a reducing flame atmosphere. Nozzle 4 deposits molten metal onto quench surface 5 of rotating casting wheel 1 to form strip 6. The depletion means in this embodiment is comprised of gas supply 12, gas nozzle 8 and ignition means 30. Valve 16 regulates the volume and velocity of gas delivered through gas nozzle 8, and a wiper brush 42 conditions quench surface 5 to help reduce oxidation thereon. After gas 24 has mixed with sufficient oxygen, ignition means 30 ignites the gas to produce a heated, low-density reducing atmosphere around upstream region 13 and around quench surface region 14 where molten metal is deposited. Suitable ignition means include spark ignition, hot filament, hot plates and the like. For example, in the embodiment shown in FIG. 4, the hot casting nozzle serves as a suitable ignition means which automatically ignites the reducing gas upon contact therewith.

The resultant flame atmosphere forms a flame plume 28 which begins upstream of quenching region 14 and consumes oxygen therefrom. In addition, unburned reducing gas within the plume reacts to reduce the oxides on quench surface 5, nozzle 4 and strip 6. The visibility of flame 28 allows easy optimization and control of the gas flow, and plume 28 is effectively drawn around the contour of wheel 1 by the wheel rotation to provide an extended reducing flame atmosphere. As a result, a hot reducing atmosphere is located around quenching surface 14 and for a discrete distant thereafter. The extended flame plume advantageously provides a non-oxidizing, protective atmosphere around strip 6 while it is cooling. Optionally, additional gas nozzles 32 and ignition means 34 can be employed to provide additional reducing flame plumes 36 along selected portions of strip 6 to further protect the strip from oxidation. A further advantage provided by the hot, reducing flame plume is that the smoothness of the free surface side of the strip (the side not in contact with the quench surface) is significantly improved. Experiments have shown that the mean roughness of the rapidly solidified metal strip, as measured by standard techniques such as pack factor, is significantly reduced when the strip is produced in the reducing flame plume of the invention.

Proper selection of the reducing gas and the temperature to which substrate 5 is heated is important. The combustion product of the burned gas should not produce a liquid or solid phase which could precipitate onto quench surface 5 or nozzle 4. For example, hydrogen gas has been unsatisfactory under ordinary conditions because the combustion product is water which condenses onto quench surface 5. As a result, under conventional casting conditions, the hydrogen flame plume does not adequately reduce the formation of gas pockets on the quench surface side of strip 6. Surprisingly, it has been found that by appropriately adjusting the casting conditions, the water precipitate normally produced by combustion of hydrogen gas within depletion region 13 can be substatially avoided. For example, if the quench surface 5 is maintained at a temperature of at least about 100° C., water will not condense out of the hydrogen flame atmosphere onto the quench surface and, therefore, will not contribute to the formation of gas pocket defects.

The reducing gas 24 is preferably a gas that will not only burn and consume oxygen in a strongly exothermic reaction, but will also produce combustion products that will remain gaseous at quench surface temperatures ranging from 800K to 1300K. Gases of this type comprise practically any gas or gas mixture which when heated or combusted produces a thermally-induced, low density atmosphere. Preferred gases include hydrogen, carbon monoxide, methane, propane and the like, and mixtures thereof. Especially preferred are reducing gases that provide an anhydrous, reducing atmosphere.

The temperature to which quench surface 5 is heated during casting depends upon the composition of the strip, the composition of the low density atmosphere present within depletion region 13 and the composition of the quench surface 5. Typically, the quench surface is heated to a temperature of at least about 323K, and preferably to a temperature of about 323K to 573K. Quench surface temperatures of at least about 373K and, most preferably of about 423K to 523K substantially prevent precipitation of condensed or solidified constituents from most anhydrous reducing atmospheres onto depletion region 13.

A reducing flame atmosphere provides an efficient means for heating the atmosphere located proximate to melt puddle 18 to very high temperatures, in the order of 1300–1400K. Such temperatures provide very low gas densities around the melt puddle 18. The high temperatures also increase the kinetics of the reduction reaction to further minimize the oxidation of quench surface 5, nozzle 4 and strip 6. A nozzle heating means is thereby provided. The presence of a hot reducing flame at nozzle 4 also reduces thermal gradients therein which might crack the nozzle and reduces clogging of the nozzle orifice 22 due to oxide particulates.

Thus, the embodiment of the invention employing a reducing flame atmosphere more efficiently produces a heated, low-density reducing atmosphere around quench surface 5 which improves the smoothness of both sides of the cast strip and more effectively prevents oxidation of quench surface 5, strip 6 and casting nozzle 4.

Figure 5:
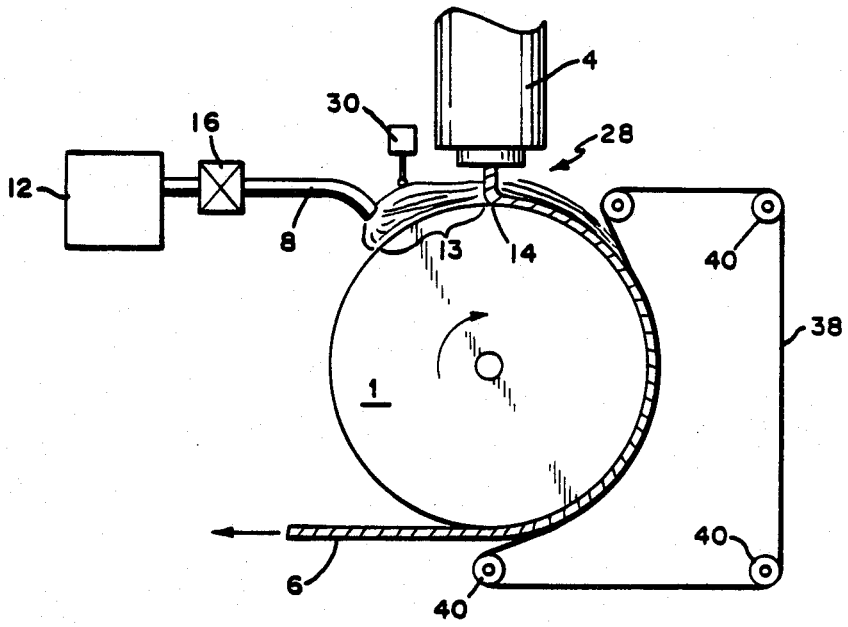
FIG. 5 shows an embodiment of the invention which employs a flexible hugger belt to prolong contact of the cast strip with the quench surface.

As shown in FIG. 5, the invention may optionally include a flexible hugger belt 38 which entrains strip 6 against quench surface 5 to prolong cooling contact therewith. The prolonged contact improves the quenching of strip 6 by providing a more uniform and prolonged cooling period for the strip. Guide wheels 40 position belt 38 in the desired hugging position along quench surface 5, and a drive means moves belt 38 such that the belt portion in hugging relation to quench surface 5 moves at a velocity substantially equal to the velocity of the quench surface. Preferably, belt 38 overlaps the marginal portions of strip 6 to directly contact and frictionally engage quench surface 5. This frictional engagement provides the required driving means to move the belt.

Considerable effort has been expended to develop devices and procedures for forming thicker strips of rapidly solidified metal because such strip can more easily be used as a direct substitute for materials presently employed in existing commercial applications. Since the present invention significantly improves the contact between the stream of molten metal and the chilled quench surface, there is improved heat transport away from the molten metal. The improved heat transport, in turn, provides a more uniform and more rapid solidification of the molten metal to produce a higher quality thick strip, i.e. strip having a thickness ranging from about 15 micrometers to as high as about 70 micrometers and more.

Similarly, considerable effort has been expended to form thinner strips of rapidly solidified metal. Very thin metal strip, less than about 15 micrometers and preferably about 8 micrometers in thickness, is highly desirable in various commercial applications. In brazing applications, for example, the filler metals used in brazed joint normaly have inferior mechanical properties compared to the base metals. To optimize the mechanical properties of a brazed assembly, the brazed joint is made very thin. Thus, when filler material in foil form is placed directly in the joint area prior to the brazing operation, the joint strength can be optimized by using a very thin brazing foil.

In magnetic applications with high frequency electronics (over 10 kHz), power losses in magnetic devices are proportional to the thickness (t) of the magnetic materials. In other magnetic applications such as saturable reactors, power losses are proportional to the thickness dimension of the magnetic material raised to the second power ($t^2$) when the material is saturated rapidly. Thus, thin ribbon decreases the power losses in the reactor. In addition, thin ribbon requires less time to saturate; as a result, shorter and sharper output pulses can be obtained from the reactor. Also, thin ribbons decrease the induced voltage per lamination and therefore, require less insulation between the laminations.

In inductors for linear induction accelerators, losses are again related to $t^2$, and the thinner ribbon will reduce power losses. Also, thin ribbon saturates more easily and rapidly and can be used to produce shorter pulse accelerators. In addition, the thinner ribbon will require reduced insulation between the laminations.

A further advantage of thin strip is that the strip experiences less bending stresses when wound to a given diameter. Excessive bending stresses will degrade the magnetic properties through the phenomenon of magneto-striction.

The apparatus and method of the invention are particularly useful for forming very thin metal strip. Since the invention significantly reduces the size and depth of gas pocket defects, there is less chance that such a defect will be large enough to perforate the cast strip. As a result, very thin strip can be cast because there is less probability that a defect large enough to perforate the strip will form. Thus, the invention can be adapted to cast very thin metal strip, which as-cast, is less than about 15 micrometers thick. Preferably, the strip has a thickness of 12 micrometers or less. More preferably, the strip thickness ranges from 7 to 12 micrometers. In addition, the thin metal strip has a width dimension which measures at least about 1.5 millimeters, and preferably measures at least about 10 mm.

EXAMPLES

A forced-convection-cooled, plain carbon steel substrate wheel used in the present investigation was 38 cm (15 in.) in diameter, 5 cm (2 in.) wide. Initially, nickel-base ribbons of composition $Ni_{68}Cr_7Fe_3B_{14}Si_{18}$ (subscripts in atomic percent) were produced on the steel wheel with low circumferential surface speed (about 10 m/s or 2,000 fpm) to avoid excessive ribbon-substrate adhesion. The substrate wheel was conditioned continuously during the run by an idling brush wheel inclined about 10° out of the casting direction.

Experiments showed that the ribbons exhibited very little adhesion on the substrate surface. An increase in casting pressure and an increase substrate surface speed helped improve ribbon-substrate adhesion. All of the ribbons cast in these initial experiments showed significant populations of entrapped air pockets in the underside, as is typically observed when ferrous alloy ribbon is cast on a copper-base substrate wheel. In the initial experiments, a dark oxidation track, which forms on the substrate surface during ribbon casting, limits the ribbon to substrate adhesion. A carbon monoxide flame directed at the ribbon casting track upstream of the melt puddle was then used to reduce oxidation and promote ribbon-substrate adhesion. The combined actions of the flame and the conditioning brush reduced the substrate oxidation, increased adhesion and produced ribbon having good geometric uniformity. Magnetic properties of ferromagnetic ribbons were also improved.

Experiments were conducted to determine if substrate oxidation occurs primarily near the melt puddle or after the point of ribbon separation from the substrate. It was found that a reducing flame in the immediate vicinity of the melt puddle resulted in a ribbon casting track having substantially reduced oxidation. The best results were obtained when the distance between the carbon monoxide flame and the back of the melt puddle was less than about 2 cm (<1 inch).

Thus, experiments have shown remarkable improvement of ribbon surface smoothness, luster, and ductility over material cast in a conventional manner. While the intrinsic wetting of a copper substrate by ferrous melts may not be as great as the wetting of an iron-based substrate, the use of a reducing flame enhances melt-copper substrate wetting to the point where a copper substrate is a viable material for the production of high quality, defect-free strip. Such a defect-free casting capability allows the production of very thin ribbon (on the order of about 7 micrometers thick). Additionally, the improved melt-substrate contact caused by carbon monoxide flame-assisted casting improves overall quench rate and enables the production of a given ribbon composition at a thickness greater than usual.

I claim:

1. An apparatus for casting metal strip, comprising:

(a) a moving chill body having a quench surface;

(b) nozzle means for depositing a stream of molten metal on a quenching region of said surface to form said strip;

(c) depletion means for supplying a low density atmosphere comprised of a gas at a depletion region located adjacent to and upstream of said quenching region said depletion means including heater means for heating said gas to a temperature of at least about 800K to produce said atmosphere; and (d) control means for heatig said quench surface to a temperture of at least about 323K, whereby precipitation of condensed or solidified constituents from said atmosphere onto said depletion region and formation of pockets in said strip are substantially prevented.

2. An apparatus as recited in claim 1, wherein said gas is a reducing gas capable of causing a chemical reduction reaction, thereby providing a reducing atmosphere.

3. An apparatus as recited in claim 2, wherein said gas is selected from the group consisting of hydrogen, carbon monoxide, methane, propane, and mixtures thereof.

4. An apparatus as recited in claim 3, further comprising ignition means for igniting said gas to produce a reducing flame atmosphere.

5. An apparatus as recited in claim 1, further comprising means for providing at least one additional low density atmosphere, composed of a low density gas, located downstream of said nozzle means.

6. An apparatus as recited in claim 5, wherein said additional atmosphere is composed of reducing gas.

7. An apparatus as recited in claim 6, further comprising ignition means for igniting the reducing gas to produce an additional reducing flame atmosphere along a selected portion of said strip.

8. An apparatus as recited in claim 1, further comprising a flexible hugger belt which entrains said strip against said quench surface to prolong contact therewith.

9. An apparatus as recited in claim 1, further comprising nozzle heating means for heating said nozzle exit portion with a reducing flame to minimize clogging of said nozzle orifice.

10. An apparatus as recited in claim 1, wherein said chill body is a casting wheel which has an annular, peripheral quench surface and is rotatable about a concentric axis of rotation.

11. An apparatus as recited in claim 1, wherein said chill body is an endless casting belt.

12. A method for casting metal strip, comprising the steps of:

(a) moving a chil body having a quench surface at a selected speed;

(b) depositing a stream of molten metal on a quenching region of said quench surface to form said strip;

(c) supplying a gas to a depletion region located adjacent to and upstream of said quenching region;

(d) heating said gas to lower the density thereof and produce within said depletion region a low density atmosphere having a temperature of at least about 800K; and (e) heating said quench surface to a temperature of at least about 323K whereby precipitation of condensed or solidified constituents from said atmosphere onto said depletion region and formation of pockets in said strip is substantially prevented.

13. A method as recited in claim 12, wherein said low density atmosphere comprises a reducing gas, thereby providing a reducing atmosphere.

14. A method as recited in claim 13, further comprising the step of igniting said reducing gas to produce a reducing flame atmosphere at said quench surface region.

15. A method as recited in claim 14, wherein said reducing gas is selected from the group consisting of hydrogen, carbon monoxide, methane, propane, and mixtures thereof.

16. A method as recited in claim 12, further comprising the step of providing an additional low density atmosphere along a selected portion of said strip.

17. A method as recited in claim 13, further comprising the step of heating said nozzle exit portion with a reducing flame to minimize clogging of said nozzle orifice.

* * * * *